US010350475B2

(12) United States Patent
Taylor et al.

(10) Patent No.: US 10,350,475 B2
(45) Date of Patent: Jul. 16, 2019

(54) APPARATUS AND METHODOLOGY THAT FACILITATES MUSCLE MEMORY TRAINING FOR OPTIMAL LIMB SEPARATION

(71) Applicant: Maxwell Taylor, Oakland, CA (US)

(72) Inventors: Maxwell Taylor, Oakland, CA (US); Mark Jackson, Madera, CA (US); Shaun Cuaron, Madera, CA (US); Richard Singleton, Madera, CA (US); Cody Scott, Madera, CA (US)

(73) Assignee: Maxwell Taylor, Oakland, CA (US)

( * ) Notice: Subject to any disclaimer, the term of this patent is extended or adjusted under 35 U.S.C. 154(b) by 0 days.

(21) Appl. No.: 15/619,370

(22) Filed: Jun. 9, 2017

(65) Prior Publication Data

US 2018/0353832 A1 Dec. 13, 2018

(51) Int. Cl.
*A63B 69/38* (2006.01)
*A63B 71/02* (2006.01)

(52) U.S. Cl.
CPC ..... *A63B 69/38* (2013.01); *A63B 71/02* (2013.01)

(58) Field of Classification Search
CPC ..... A63B 69/00; A41F 3/00
See application file for complete search history.

(56) References Cited

U.S. PATENT DOCUMENTS 3,256,529 A * 6/1966 Panepinto ..... A41F 3/02 2/301
5,348,292 A * 9/1994 Norman, Sr. ..... A63B 69/0059 473/213
2015/0011338 A1* 1/2015 Russotti ..... A63B 69/00 473/422

* cited by examiner

*Primary Examiner* — Eugene L Kim
*Assistant Examiner* — Christopher A Glenn
(74) *Attorney, Agent, or Firm* — Loza & Loza, LLP; Daniel S. Castro

(57) ABSTRACT

A training apparatus is disclosed, which includes a first strap configured to attach to a first limb, and a second strap configured to attach to a second limb. The training apparatus also includes a severable connector assembly coupled to the first strap on one end, and to the second strap on an opposite end. The severable connector assembly is reusable and configured to sever according to a threshold breakaway force. In a particular embodiment, the severable connector assembly is an injection design comprising a male component configured to mate with a female component, and further configured to sever from the female component according to a threshold breakaway force. In another embodiment, the severable connector assembly is a magnetic design comprising a first clasp configured to magnetically attach to a second clasp, and further configured to sever from the second clasp according to a threshold breakaway force.

13 Claims, 11 Drawing Sheets

APPARATUS AND METHODOLOGY THAT FACILITATES MUSCLE MEMORY TRAINING FOR OPTIMAL LIMB SEPARATION

TECHNICAL FIELD

The subject disclosure generally relates to muscle memory training, and more specifically to muscle memory training for optimal limb separation.

BACKGROUND

For many sports, an optimal separation of limbs from each other when executing particular movements is desired. In tennis, for example, beginners are trained to keep their wrists together when executing a "volley" (i.e., a short swing commonly used when a player transitions to the net). Similarly, in boxing, beginners are trained to take small steps, wherein the feet are kept at an optimal distance from each other.

Conventional training techniques for maintaining such an optimal limb separation, however, have many disadvantages. For instance, limbs are commonly tied together with rope to ensure that they do not separate beyond a threshold training distance from each other. For many types of training drills though, such technique is often undesirable. In the aforementioned tennis example, for instance, a user would likely need help to tie his/her wrists together. Using a rope can also be hazardous for some types of training drills, especially for drills that are preferably performed at full speed. In the aforementioned boxing example, for instance, a user with his/her ankles tied together may trip and fall during a sparring session.

Accordingly, it would be desirable to provide an apparatus and methodology which overcomes these limitations. To this end, it should be noted that the above-described deficiencies are merely intended to provide an overview of some of the problems of conventional systems, and are not intended to be exhaustive. Other problems with the state of the art and corresponding benefits of some of the various non-limiting embodiments may become further apparent upon review of the following detailed description.

SUMMARY

A simplified summary is provided herein to help enable a basic or general understanding of various aspects of exemplary, non-limiting embodiments that follow in the more detailed description and the accompanying drawings. This summary is not intended, however, as an extensive or exhaustive overview. Instead, the sole purpose of this summary is to present some concepts related to some exemplary non-limiting embodiments in a simplified form as a prelude to the more detailed description of the various embodiments that follow.

In accordance with one or more embodiments and corresponding disclosure, various non-limiting aspects are described in connection with muscle memory training for optimal limb separation. In one such aspect, a training apparatus is provided, which includes a first strap configured to attach to a first limb of a user, and a second strap configured to attach to a second limb of the user. The training apparatus also includes a severable connector assembly coupled to the first strap on one end, and coupled to the second strap on an opposite end. For this particular embodiment, the severable connector assembly is reusable and configured to sever according to a threshold breakaway force.

In a further aspect, another training apparatus is provided. Here, the training apparatus again includes a first strap configured to attach to a first limb of a user, and a second strap configured to attach to a second limb of the user. The training apparatus also similarly includes a severable connector assembly coupled to the first strap on one end, and coupled to the second strap on an opposite end. For this embodiment, however, the severable connector assembly comprises a reusable injection design having a male component configured to mate with a female component, and further configured to sever from the female component according to a threshold breakaway force.

In yet a further aspect, another training apparatus is provided. Here, the training apparatus again includes a first strap configured to attach to a first limb of a user, and a second strap configured to attach to a second limb of the user. The training apparatus also similarly includes a severable connector assembly coupled to the first strap on one end, and coupled to the second strap on an opposite end. For this embodiment, however, the severable connector assembly comprises a reusable magnetic design having a first clasp configured to magnetically attach to a second clasp, and further configured to sever from the second clasp according to a threshold breakaway force.

Other embodiments and various non-limiting examples, scenarios and implementations are described in more detail below.

BRIEF DESCRIPTION OF THE DRAWINGS

Various non-limiting embodiments are further described with reference to the accompanying drawings in which.

DETAILED DESCRIPTION

Overview

The embodiments disclosed herein are directed towards overcoming the various limitations of conventional training techniques for maintaining an optimal limb separation. In a first exemplary embodiment, a tennis training apparatus directed towards volley swings is disclosed, which prevents a player from separating his/her arms beyond a threshold distance from each other. Namely, the apparatus comprises adjustable wrist straps that join the left and right wrists, which prevent the wrists from separating beyond a threshold distance. By tethering the wrists together in such a manner, the wrists and arms are thus forced to stay in front of the body, which desirably facilitates muscle memory training for volley swings. When the wrists are tethered, the player is also no longer able to move their elbows or wrists behind their body, which forces the player's upper body to desirably stay upright over both legs at all times. Moreover, in order to generate more power when a player's wrists are tethered, the player must turn his/her entire upper body as a unit with his/her hands remaining in front, which is a generally desired technique, rather than taking his/her hands further behind the body, which is undesirable.

In another aspect, it is contemplated that the aforementioned wrist straps may include a breakaway mechanism (e.g., a clasp), wherein the left and right wrist straps are allowed to break away from each other when the threshold distance is exceeded. Here, in addition to adjusting the threshold distance via the adjustable straps, it is also contemplated that the breakaway mechanism may be configured to breakaway when a particular breakaway force is applied. Alternatively, the breakaway mechanism may include a force adjustment mechanism, wherein a player may adjust the amount of force necessary to break the wrist straps away from each other.

In a further aspect, a three step tennis training method is disclosed. In the first step, a player is trained to keep their wrists together using the non-breakaway apparatus described above. Then, once the player feels he/she has generated adequate muscle memory, the player proceeds to the second step, wherein the aforementioned breakaway apparatus is used. By using the breakaway apparatus, rather than simply the non-breakaway apparatus, the player will instantly know when they have excessively separated their wrists, and thus adjust accordingly. And finally, when the player consistently performs volley swings without having the training apparatus breakaway, the method concludes with the apparatus being removed.

In yet another aspect, it is contemplated that any of the aforementioned items may be applied to legs/feet for other sports. For instance, a similar method may be used for boxing, wherein the boxer begins with a non-breakaway apparatus tethered to both ankles, and wherein the boxer subsequently uses a breakaway apparatus.

Exemplary Injection Design Embodiment

Figure 1:
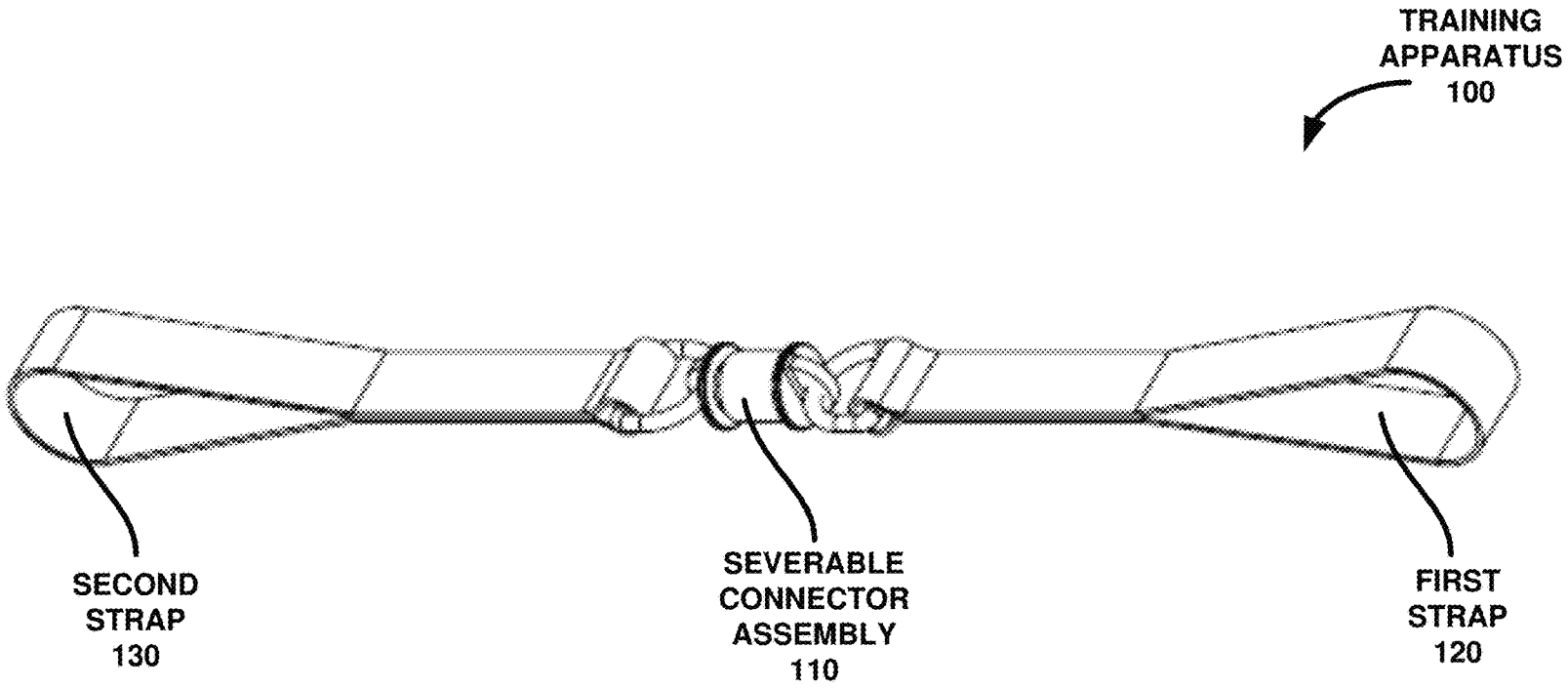
FIG. 1 illustrates a perspective view of an exemplary training apparatus having an injection design in accordance with an aspect of the subject specification.
Figure 2:
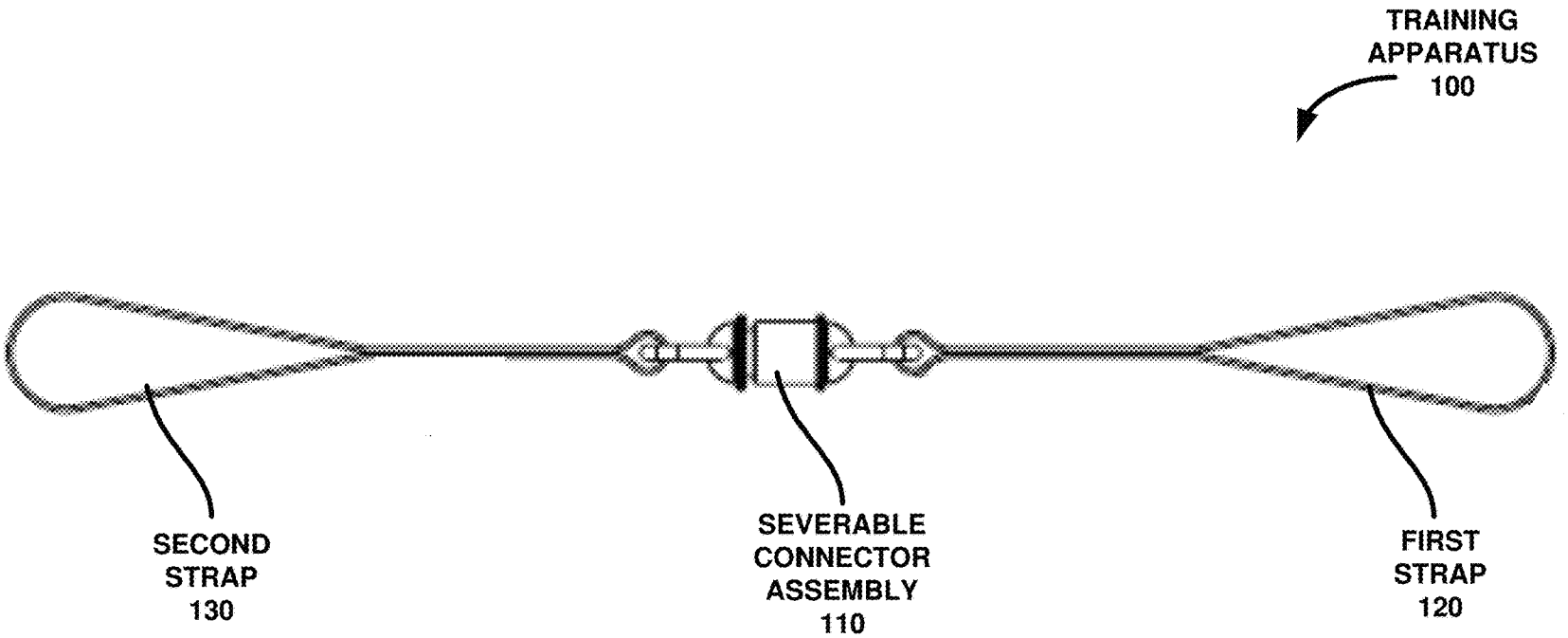
FIG. 2 illustrates a side view of an exemplary training apparatus having an injection design in accordance with an aspect of the subject specification.
Figure 3:
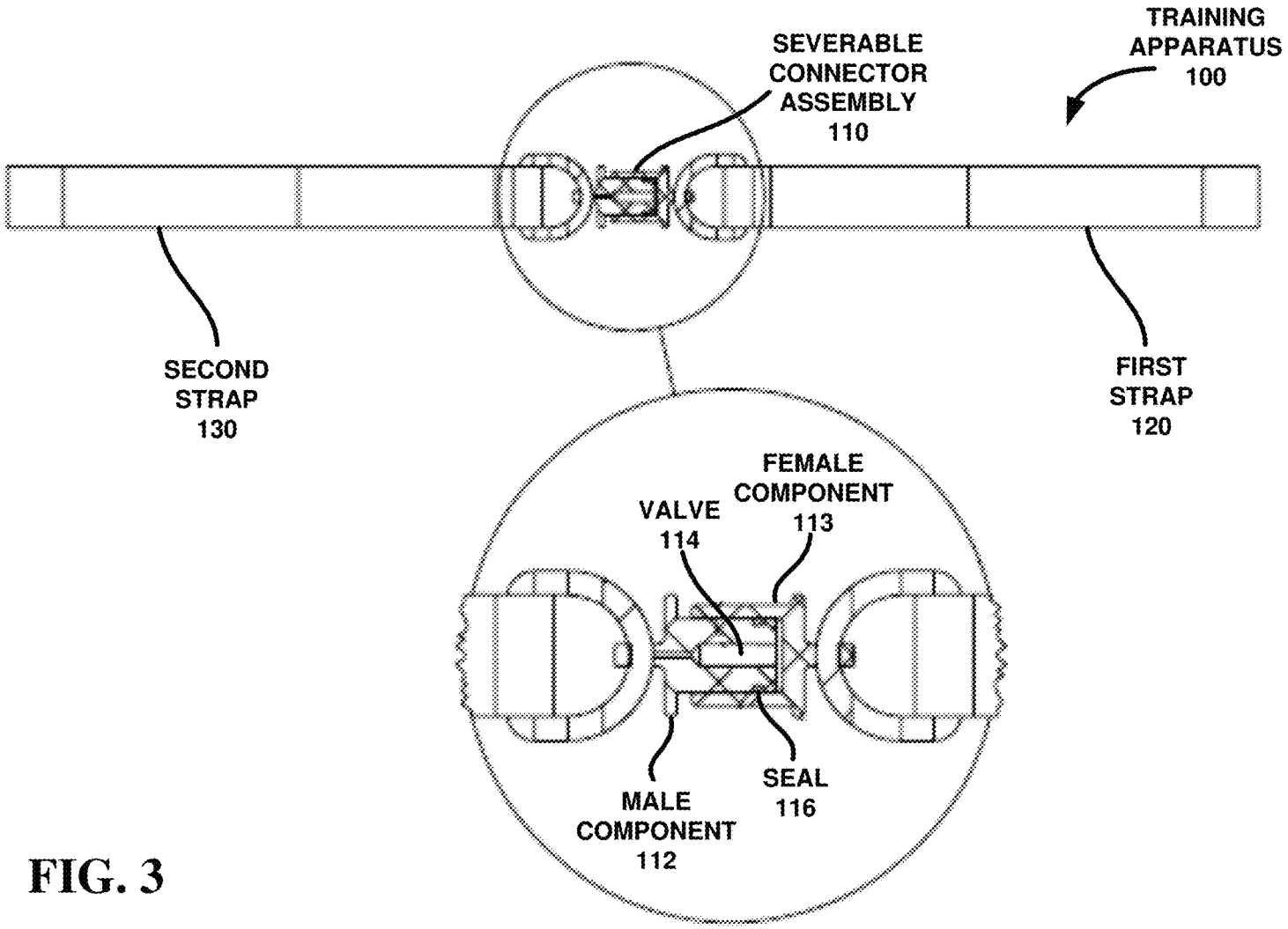
FIG. 3 illustrates an inner view of an exemplary connector assembly having an injection design in accordance with an aspect of the subject specification.
Figure 4:
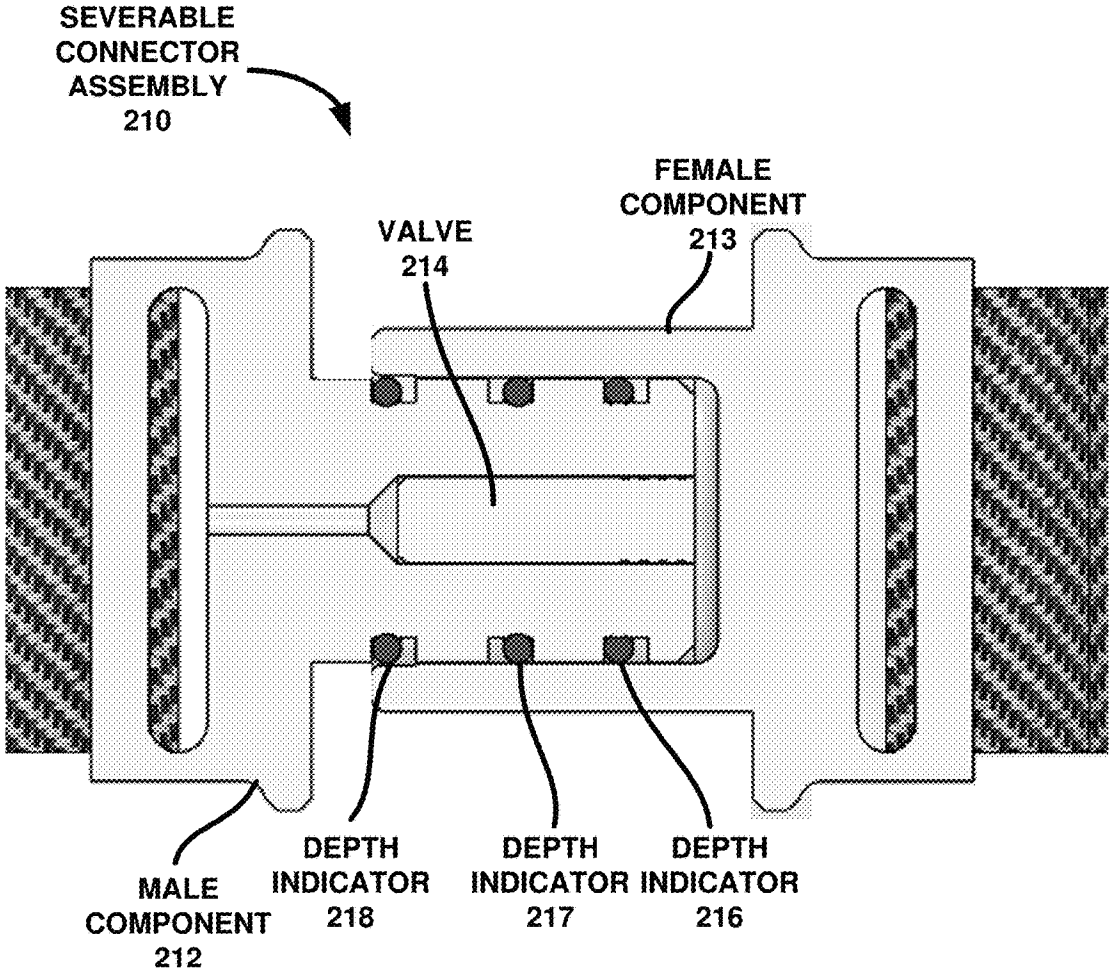
FIG. 4 illustrates an inner view of an exemplary connector assembly having a plurality of breakaway force indicators in accordance with an aspect of the subject specification.
Figure 5:
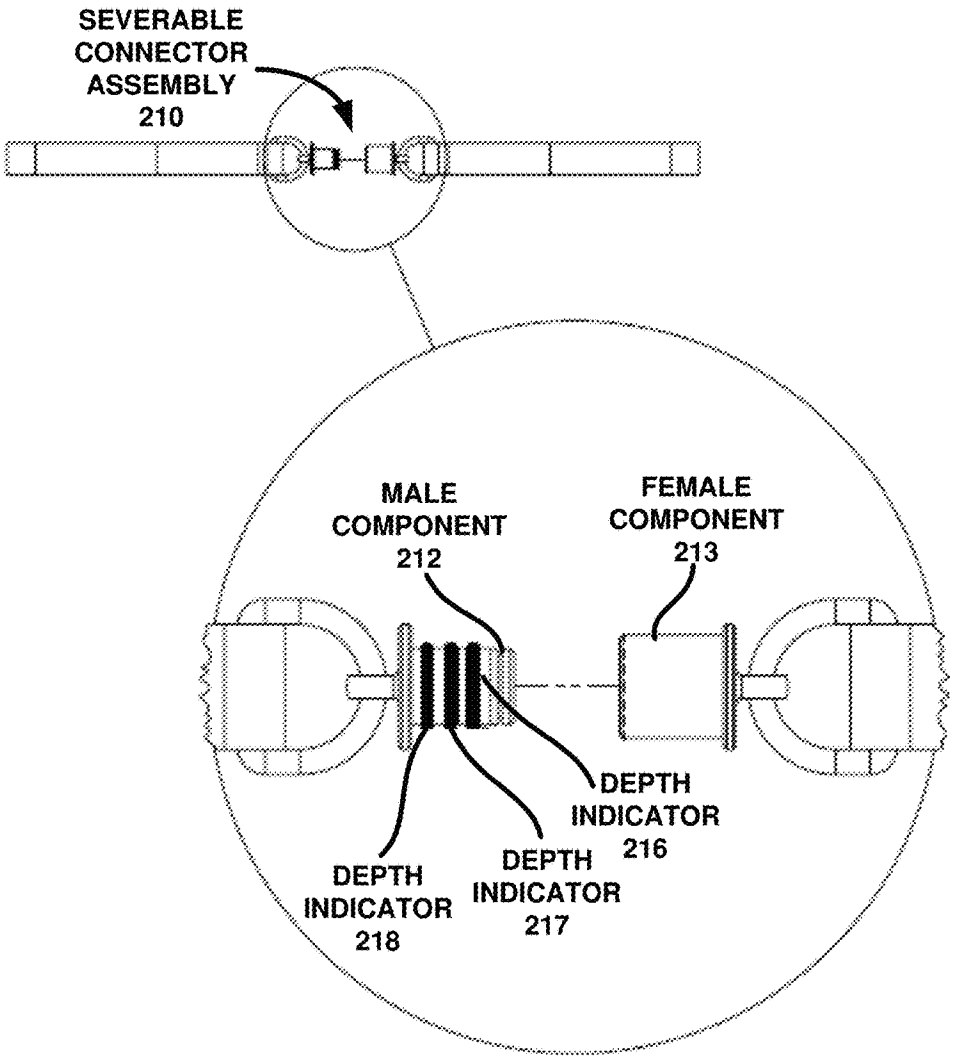
FIG. 5 illustrates a severed view of an exemplary connector assembly having a plurality of breakaway force indicators in accordance with an aspect of the subject specification.
Figure 6:
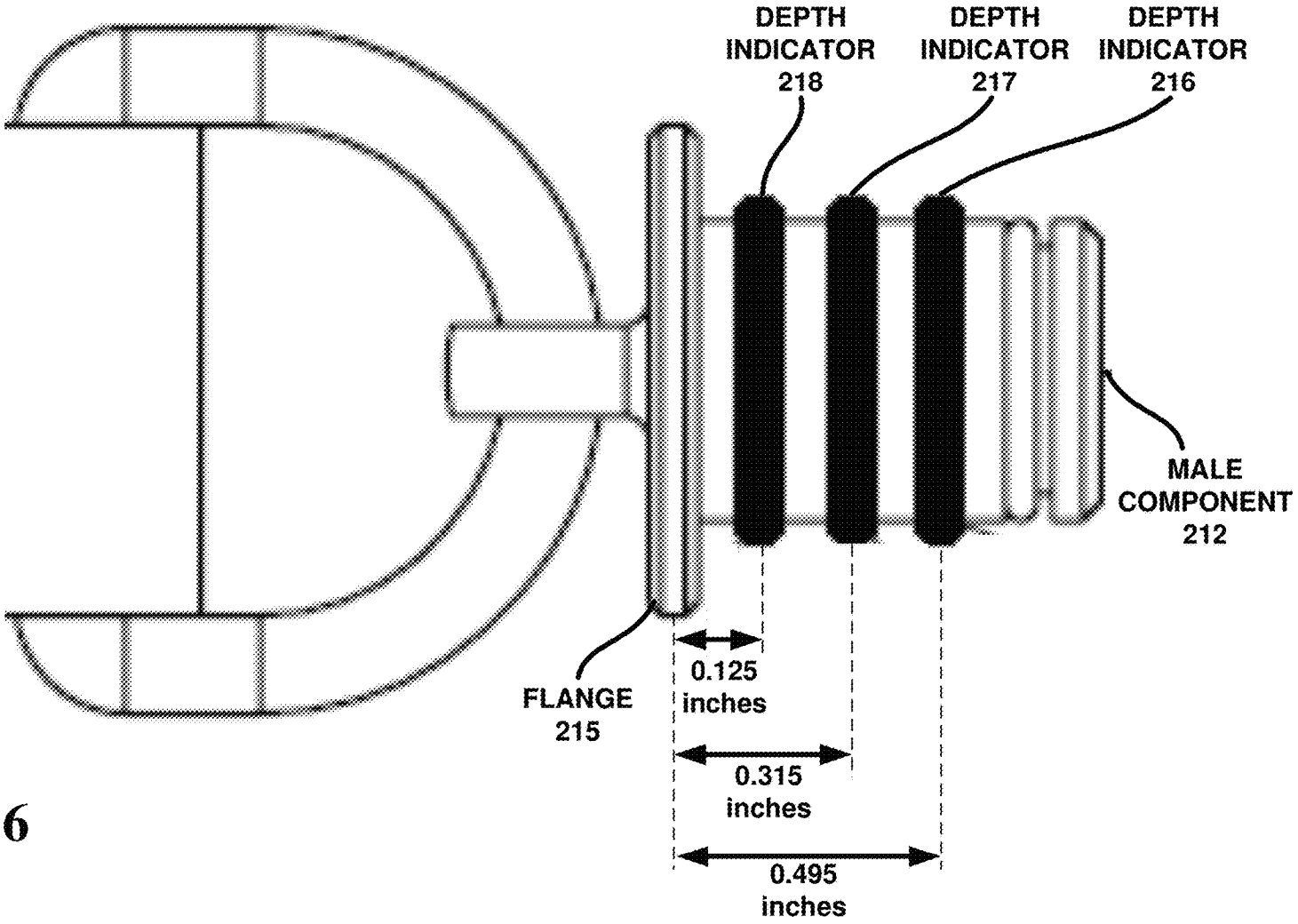
FIG. 6 illustrates dimensions of an exemplary male component having a plurality of breakaway force indicators in accordance with an aspect of the subject specification.

Turning now to FIGS. 1-6, various views are provided of an exemplary training apparatus having an injection design in accordance with an aspect of the subject specification. In particular, FIG. 1 illustrates a perspective view of an exemplary training apparatus having an injection design; FIG. 2 illustrates a side view of an exemplary training apparatus having an injection design; FIG. 3 illustrates an inner view of an exemplary connector assembly having an injection design; FIG. 4 illustrates an inner view of an exemplary connector assembly having a plurality of breakaway force indicators; FIG. 5 illustrates a severed view of an exemplary connector assembly having a plurality of breakaway force indicators; and FIG. 6 illustrates dimensions of an exemplary male component having a plurality of breakaway force indicators.

As illustrated in FIGS. 1-3, it is contemplated that a training apparatus 100 may include a first strap 120 configured to attach to a first limb of a user, and a second strap 130 configured to attach to a second limb of the user. The training apparatus 100 also includes a severable connector assembly 110 coupled to the first strap 120 on one end, and coupled to the second strap 130 on an opposite end, as shown. For this particular embodiment, the severable connector assembly 110 comprises a reusable injection design having a male component 112 configured to mate with a female component 113, and further configured to sever from the female component 113 according to a threshold breakaway force.

As illustrated in FIG. 3, it is contemplated that the severable connector assembly 110 may comprise a syringe-like design. Within such embodiment, the female component 113 may be a cylinder, whereas the male component 112 may be a piston comprising a one-way valve 114 and a seal 116 (e.g., an O-ring, gasket, wiper seal, etc.), as shown. During use, the male component 112 is inserted into the female component 113, wherein the seal 116 creates an airtight seal between the cylindrical female component 113 and the piston-like male component 112. The one-way valve 114 is configured to allow air to exit the chamber between the cylinder (i.e., the female component 113) and the piston (i.e., the male component 112), wherein the piston has an air path to the atmosphere allowing air to escape the one-way valve 114, and wherein the one-way valve 114 does not allow air to return to the chamber. As a result, a resistive vacuum is created in the chamber between the piston and the cylinder, which provides a counterforce when the user attempts to pull the severable connector assembly 110 apart.

In another aspect of the disclosure, it is contemplated that the severable connector assembly 110 may comprise a breakaway force adjustment mechanism. For instance, the threshold breakaway force may vary according to an insertion depth of the male component 112 relative to the female component 113. Moreover, because the resistive vacuum created in the chamber between the piston and the cylinder increases as the piston is inserted deeper into the cylinder, a user may adjust the threshold breakaway force required to pull the severable connector assembly 110 apart according to the insertion depth of the piston.

In a particular embodiment, it is contemplated that the male component 112 may be configured to include a plurality of threshold breakaway force indicators. For instance, as illustrated in FIGS. 4-6, an exemplary severable connector assembly 210 is provided in which the male component 212 comprises a plurality of threshold breakaway force indicators 216, 217, and 218. Similar to severable connector assembly 110, it is contemplated that the threshold breakaway force required to pull the severable connector assembly 210 apart is facilitated by a one-way valve 214 and may be adjusted according to how deep the male component 212 is inserted into the female component 213. Here, however, a plurality of threshold breakaway force indicators 216, 217, and 218 are provided, wherein each of the plurality of threshold breakaway force indicators 216, 217, and 218 correspond to a different insertion depth (i.e., distance from flange 215) respectively associated with a different threshold breakaway force. For instance, with respect to the exemplary embodiment illustrated in FIG. 6, breakaway force indicator 216 corresponds to a threshold breakaway force of 8.5 pound force (lbf) and an insertion depth of 0.125 inches; breakaway force indicator 217 corresponds to a threshold breakaway force of 7.5 lbf and an insertion depth of 0.315 inches; and breakaway force indicator 218 corresponds to a third threshold breakaway force of 5.5 lbf and an insertion depth of 0.495 inches.

Exemplary Magnetic Design Embodiment

Figure 7:
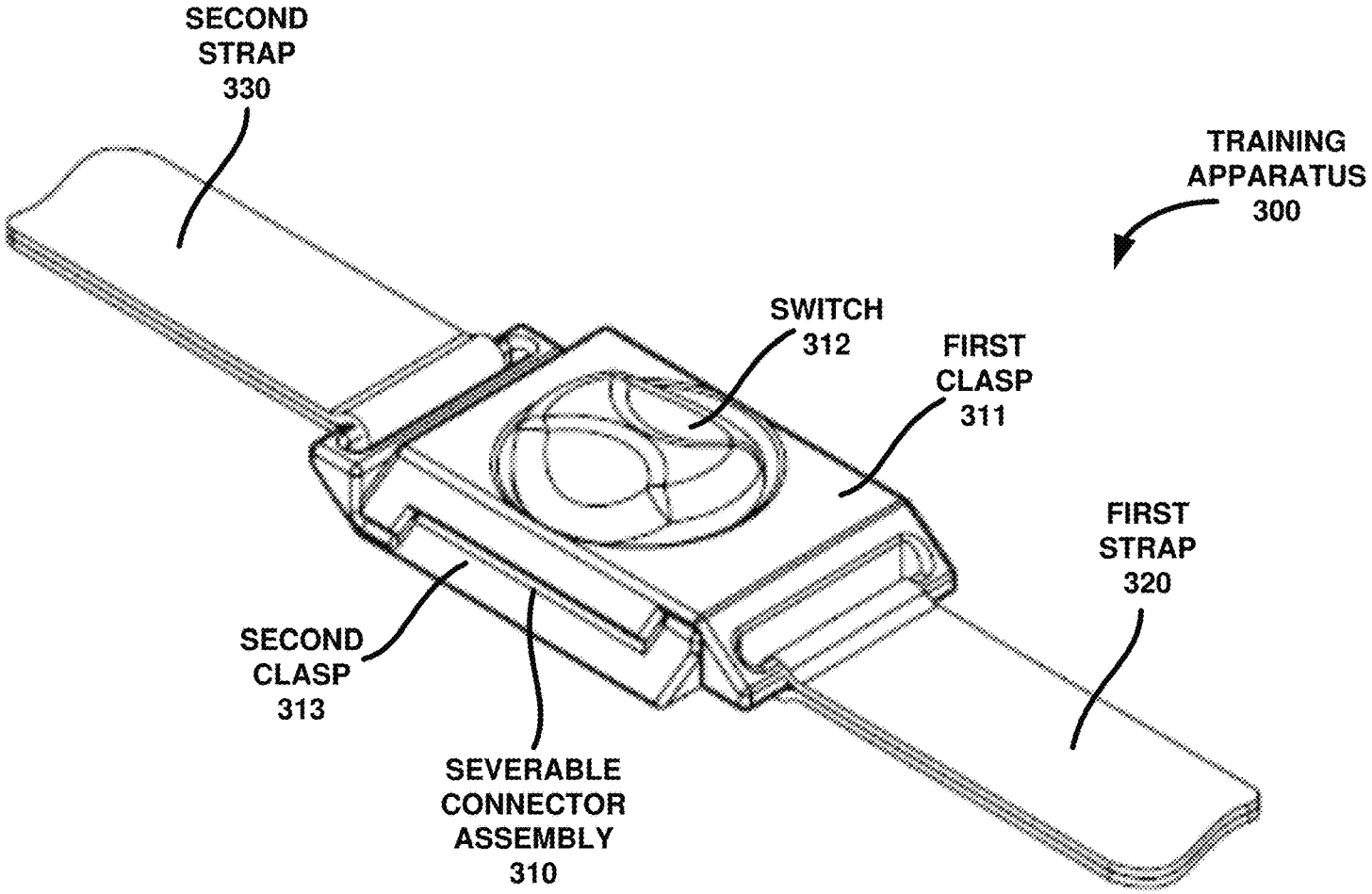
FIG. 7 illustrates a perspective view of an exemplary training apparatus having a magnetic design in accordance with an aspect of the subject specification.
Figure 8:
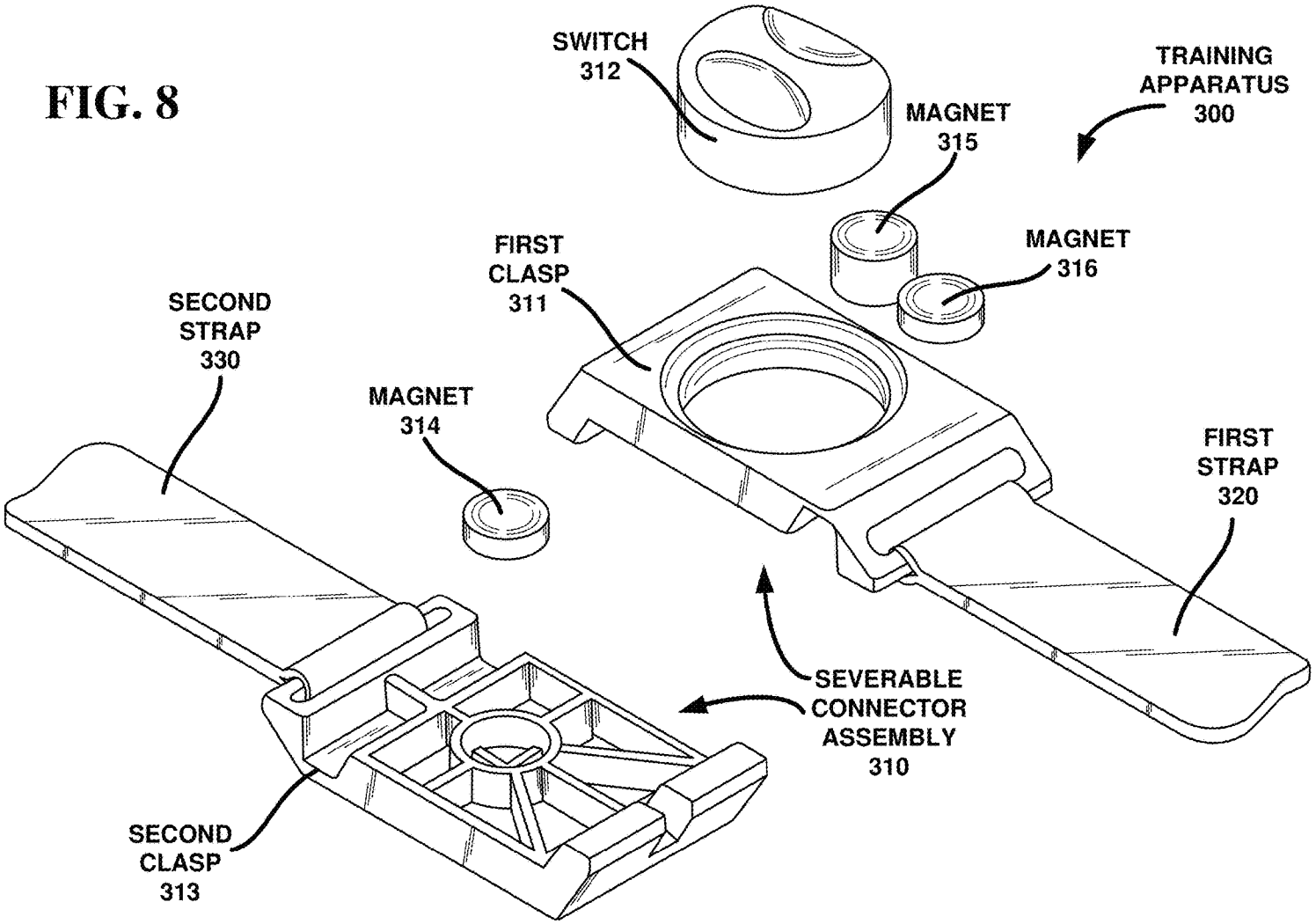
FIG. 8 illustrates an exploded view of an exemplary training apparatus having a magnetic design in accordance with an aspect of the subject specification.
Figure 9:
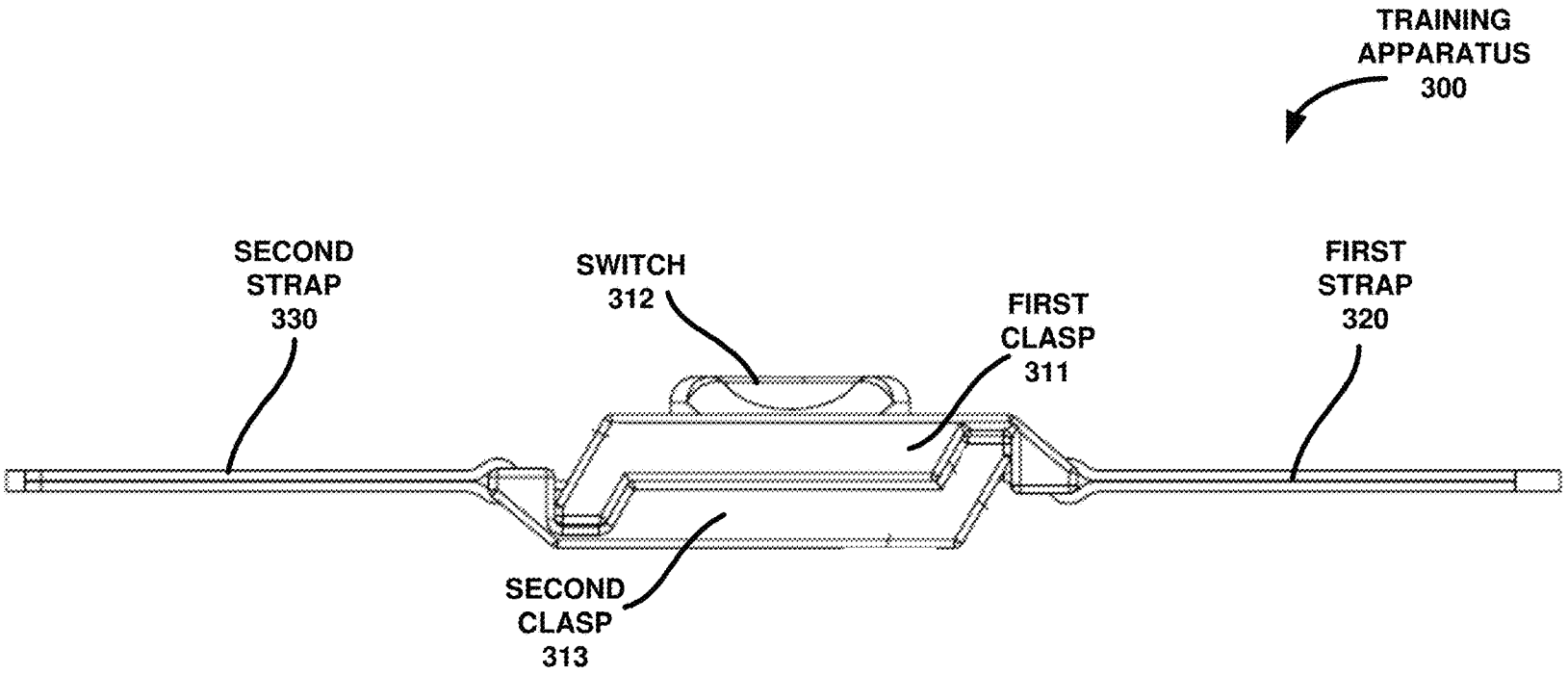
FIG. 9 illustrates a side view of an exemplary training apparatus having a magnetic design in accordance with an aspect of the subject specification.
Figure 10:
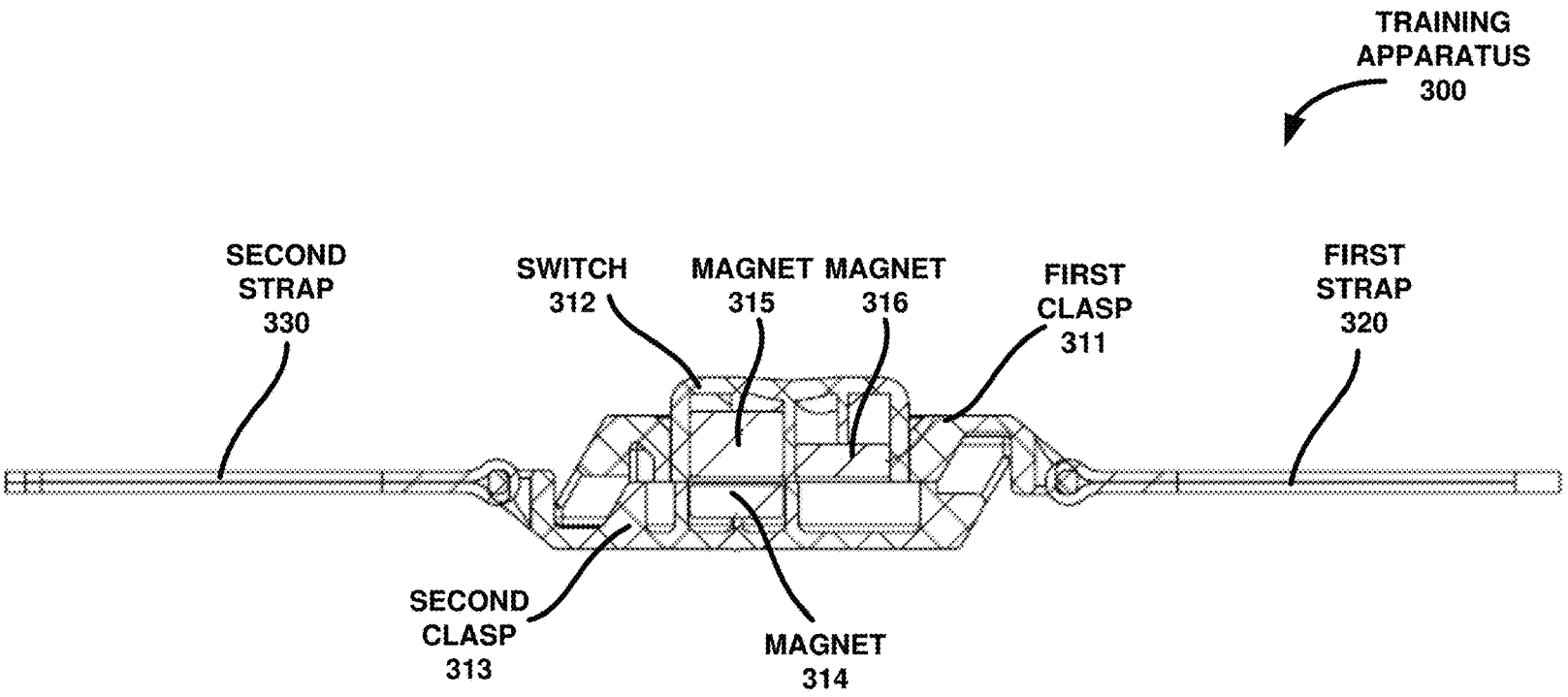
FIG. 10 illustrates an inner view of an exemplary training apparatus having a magnetic design in accordance with an aspect of the subject specification.

Turning now to FIGS. 7-10, various views are provided of an exemplary training apparatus having a magnetic design in accordance with an aspect of the subject specification. In particular, FIG. 7 illustrates a perspective view of an exemplary training apparatus having a magnetic design; FIG. 8 illustrates an exploded view of an exemplary training apparatus having a magnetic design; FIG. 9 illustrates a side view of an exemplary training apparatus having a magnetic design; and FIG. 10 illustrates an inner view of an exemplary training apparatus having a magnetic design.

As illustrated, it is contemplated that a training apparatus 300 may include a first strap 320 configured to attach to a first limb of a user, and a second strap 330 configured to attach to a second limb of the user. The training apparatus 300 also includes a severable connector assembly 310 coupled to the first strap 320 on one end, and coupled to the second strap 330 on an opposite end, as shown. For this particular embodiment, the severable connector assembly 310 comprises a reusable magnetic design having a first clasp 311 configured to magnetically attach to a second clasp 313, and further configured to sever from the second clasp 313 according to a threshold breakaway force.

For this embodiment, it is contemplated that the threshold breakaway force of the severable connector assembly 310 will depend on how strongly the first clasp 311 is magnetically coupled to the second clasp 313. Accordingly, it is further contemplated that the severable connector assembly 310 may comprise a breakaway force adjustment mechanism, wherein the threshold breakaway force varies according to an adjustable magnetic force between the first clasp 311 and the second clasp 313. For instance, the breakaway force adjustment mechanism may be configured to facilitate a replacement of magnets in at least one of the first clasp 311 (e.g., magnet 314) or the second clasp 313 (e.g., magnet 315 and/or magnet 316). Alternatively, rather than replacing magnets, the breakaway force adjustment mechanism may be configured to facilitate an addition of magnets in at least one of the first clasp 311 or the second clasp 313.

Several other breakaway force adjustment mechanisms are also contemplated. For instance, as illustrated in FIGS. 7-10, the breakaway force adjustment mechanism may comprise a switch 312 coupled to a plurality of magnets 315, 316 housed in the first clasp 311, wherein the switch 312 is configured to vary the magnetic force between the first clasp 311 and the second clasp 313 according to which of the plurality of magnets 315, 316 is magnetically coupled to a magnet of opposite polarity 314 housed in the second clasp 313. For this particular example, the switch 312 is configured as a rotatable dial in which a user may toggle between a smaller threshold breakaway force and a larger threshold breakaway force. For example, if the magnetic force of magnet 315 is larger than the magnetic force of magnet 316, a smaller threshold breakaway force results from rotating the dial such that magnet 314 is magnetically coupled with magnet 316, whereas a larger threshold breakaway force results from rotating the dial such that magnet 314 is magnetically coupled with magnet 315. Here, although switch 312 is shown to include only magnets 315 and 316, it should be appreciated that switch 312 may be configured to include any number of magnets of different strengths and respectively corresponding to a different threshold breakaway force.

Exemplary Methodology

Figure 11:
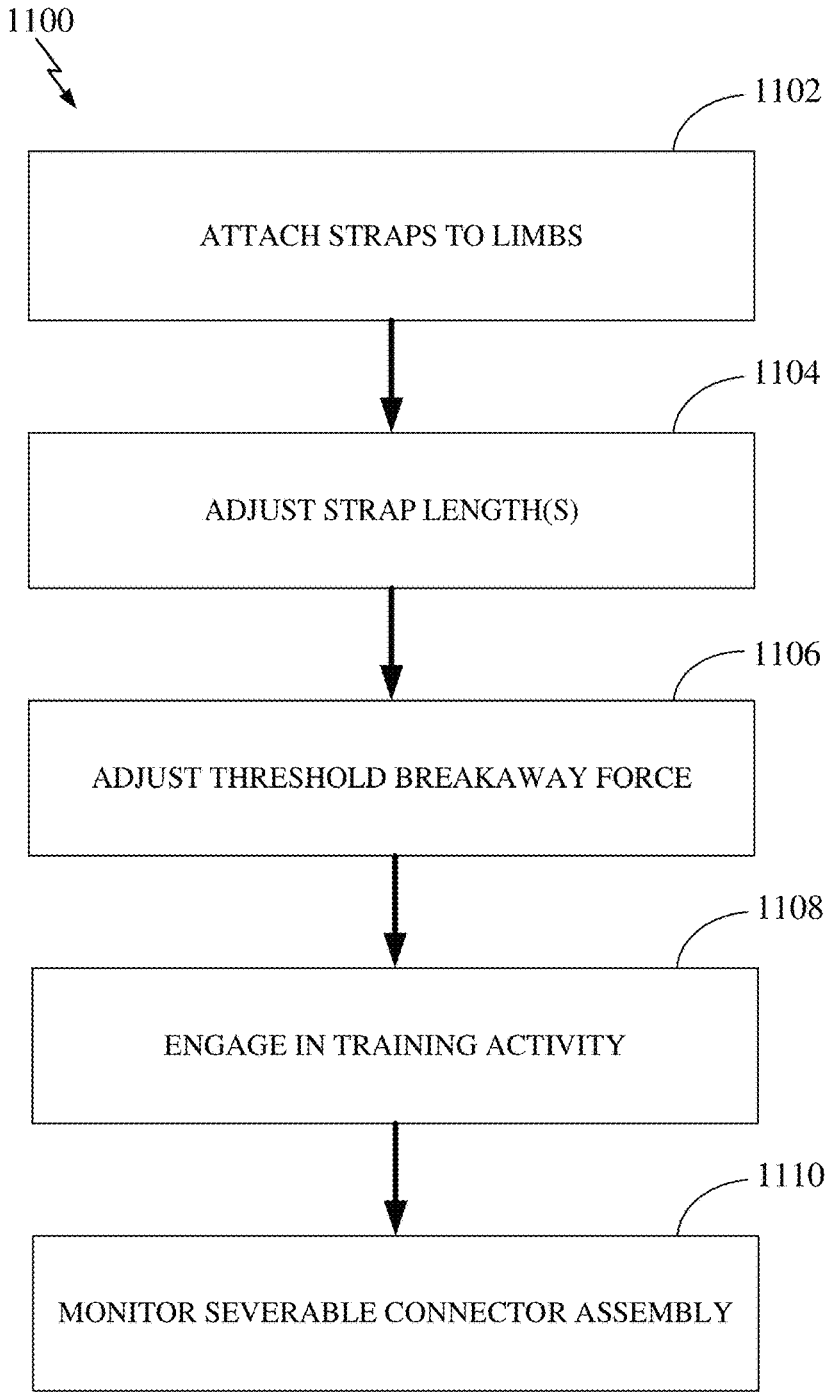
FIG. 11 is a flow diagram of an exemplary methodology that facilitates muscle memory training for optimal limb separation in accordance with an aspect of the subject specification.

Referring next to FIG. 11, a flow diagram is provided of an exemplary methodology that facilitates muscle memory training for optimal limb separation in accordance with an aspect of the subject specification. As illustrated, process 1100 includes a series of acts that may be performed by a user in conjunction with any of the training apparatuses disclosed herein (e.g., training apparatus 100 or training apparatus 200).

In an aspect, process 1100 begins at act 1102 with the user attaching the straps of the training apparatus to the limbs the user wants to train for optimal limb separation. For example, a tennis player may train by attaching the straps to his/her wrists so as to improve muscle memory in which his/her hands are not separated beyond a threshold distance (i.e., so that both hands are kept on the tennis racquet). Similarly, a boxer may train by attaching the straps to his/her ankles so as to improve muscle memory in which his/her feet are not separated beyond a threshold distance (i.e., so that both feet are kept at a desirable distance from each other). After attaching the straps at act 1102, the user may then adjust each strap length at act 1104 according to the desired threshold limb separation distance.

As previously discussed, it is contemplated that adjusting the threshold breakaway force of a training apparatus may be desired. Accordingly, process 1100 may further include act 1106 in which the user adjusts the threshold breakaway force to a desired setting. Such adjustment may be achieved via any of a plurality of mechanisms including, for example, varying an injection depth of a training apparatus comprising an injection design (e.g., training apparatus 100), or rotating a dial switch of a training apparatus comprising a magnetic design (e.g., training apparatus 300).

After adjusting the threshold breakaway force at act 1106, the user may then engage in his/her desired training activity at act 1108, and subsequently monitor the severable connector assembly of the training apparatus at act 1110. In tennis, for example, the user may engage in a training drill for volleys, wherein he/she monitors whether the severable connector assembly has come apart (e.g., indicating whether he/she desirably kept both hands on the racquet throughout the drill). Similarly, a boxer may engage in a sparring drill, wherein he/she also monitors whether the severable connector assembly has come apart (e.g., indicating whether he/she desirably kept both feet within a threshold distance from each other throughout the drill).

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components coupled to other components rather than included within parent components (hierarchical). Additionally, it is noted that one or more components may be combined into a single component providing aggregate functionality or divided into several separate sub-components, and any one or more middle layers may be provided to couple to such sub-components in order to provide integrated functionality. Any components described herein may also interact with one or more other components not specifically described herein but generally known by those of skill in the art.

In view of the exemplary systems described supra, methodologies that may be implemented in accordance with the disclosed subject matter can be appreciated with reference to the various figures. While for purposes of simplicity of explanation, the methodologies are described as a series of steps, it is to be understood and appreciated that the disclosed subject matter is not limited by the order of the steps, as some steps may occur in different orders and/or concurrently with other steps from what is described herein. Moreover, not all disclosed steps may be required to implement the methodologies described hereinafter.

While the various embodiments have been described in connection with the exemplary embodiments of the various figures, it is to be understood that other similar embodiments may be used or modifications and additions may be made to the described embodiment for performing the same function without deviating there from. Therefore, the present invention should not be limited to any single embodiment.

What is claimed is:

1. A training apparatus, comprising: a first strap configured to attach to a first limb of a user; a second strap configured to attach to a second limb of the user; and a severable connector assembly coupled to the first strap on one end, and coupled to the second strap on an opposite end, wherein: the severable connector assembly is reusable and configured to sever according to a threshold breakaway force; the severable connector assembly comprises a magnetic design having a first clasp configured to magnetically attach to a second clasp; the severable connector assembly comprises a breakaway force adjustment mechanism; and the threshold breakaway force varies according to an adjustable magnetic force between the first clasp and the second clasp; wherein the breakaway force adjustment mechanism comprises a switch coupled to a plurality of magnets housed in the first clasp, and wherein the switch is configured to vary the magnetic force between the first clasp and the second clasp according to which of the plurality of magnets is magnetically coupled to a magnet of opposite polarity housed in the second clasp.

2. The training apparatus of claim 1, wherein the severable connector assembly comprises an injection design having a male component configured to mate with a female component.

3. The training apparatus of claim 2, wherein the severable connector assembly comprises a breakaway force adjustment mechanism, and wherein the threshold breakaway force varies according to an insertion depth of the male component relative to the female component.

4. The training apparatus of claim 3, wherein the male component comprises a one way valve configured to allow air to exit a chamber between the male component and the female component, and wherein the one way valve is further configured to prevent air from entering the chamber.

5. The training apparatus of claim 3, wherein the male component includes a plurality of threshold breakaway force indicators, and wherein each of the plurality of threshold breakaway force indicators correspond to a different insertion depth respectively associated with a different threshold breakaway force.

6. The training apparatus of claim 1, wherein the breakaway force adjustment mechanism is configured to facilitate a replacement of magnets in at least one of the first clasp or the second clasp.

7. The training apparatus of claim 1, wherein the breakaway force adjustment mechanism is configured to facilitate an addition of magnets in at least one of the first clasp or the second clasp.

8. A training apparatus, comprising:

a first strap configured to attach to a first limb of a user;

a second strap configured to attach to a second limb of the user; and a severable connector assembly coupled to the first strap on one end, and coupled to the second strap on an opposite end, wherein:

the severable connector assembly comprises a reusable injection design having a male component configured to mate with a female component, and further configured to sever from the female component according to a threshold breakaway force;

the severable connector assembly comprises a breakaway force adjustment mechanism in which the threshold breakaway force varies according to an insertion depth of the male component relative to the female component;

the male component comprises a one way valve configured to allow air to exit a chamber between the male component and the female component; and the one way valve is further configured to prevent air from entering the chamber.

9. The training apparatus of claim 8, wherein the male component includes a plurality of threshold breakaway force indicators, and wherein each of the plurality of threshold breakaway force indicators correspond to a different insertion depth respectively associated with a different threshold breakaway force.

10. The training apparatus of claim 9, wherein the plurality of breakaway force indicators include:

a first breakaway force indicator corresponding to a first threshold breakaway force of 8.5 pound force (lbf) and a first insertion depth of 0.125 inches;

a second breakaway force indicator corresponding to a second threshold breakaway force of 7.5 lbf and a second insertion depth of 0.315 inches; and a third breakaway force indicator corresponding to a third threshold breakaway force of 5.5 lbf and a third insertion depth of 0.495 inches.

11. A training apparatus, comprising:

a first strap configured to attach to a first limb of a user;

a second strap configured to attach to a second limb of the user; and a severable connector assembly coupled to the first strap on one end, and coupled to the second strap on an opposite end, wherein:

the severable connector assembly comprises a reusable magnetic design having a first clasp configured to magnetically attach to a second clasp, and further configured to sever from the second clasp according to a threshold breakaway force;

the severable connector assembly comprises a breakaway force adjustment mechanism in which the threshold breakaway force varies according to an adjustable magnetic force between the first clasp and the second clasp;

the breakaway force adjustment mechanism comprises a switch coupled to a plurality of magnets housed in the first clasp; and the switch is configured to vary the magnetic force between the first clasp and the second clasp according to which of the plurality of magnets is magnetically coupled to a magnet of opposite polarity housed in the second clasp.

12. The training apparatus of claim 11, wherein the breakaway force adjustment mechanism is configured to facilitate a replacement of magnets in at least one of the first clasp or the second clasp.

13. The training apparatus of claim 11, wherein the breakaway force adjustment mechanism is configured to facilitate an addition of magnets in at least one of the first clasp or the second clasp.

* * * * *